US009113258B2

(12) United States Patent
Liu et al.

(10) Patent No.: US 9,113,258 B2
(45) Date of Patent: Aug. 18, 2015

(54) SPEAKER

(75) Inventors: Lin Liu, Shenzhen (CN); Xu-Dong Yan, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 291 days.

(21) Appl. No.: 13/190,571

(22) Filed: Jul. 26, 2011

(65) Prior Publication Data

US 2012/0128195 A1 May 24, 2012

(30) Foreign Application Priority Data

Nov. 18, 2010 (CN) ..... 2010 1 0549144

(51) Int. Cl.

| | |
|---|---|
| ***H04R 1/02*** | (2006.01) |
| ***H04R 7/18*** | (2006.01) |
| *H04R 9/02* | (2006.01) |
| *H04R 9/04* | (2006.01) |
| *H04R 9/06* | (2006.01) |

(52) U.S. Cl.

CPC *H04R 7/18* (2013.01); *H04R 9/025* (2013.01); *H04R 9/045* (2013.01); *H04R 9/063* (2013.01); *H04R 2307/207* (2013.01)

(58) Field of Classification Search

USPC ..... 381/386, 401, 412

See application file for complete search history.

(56) References Cited

U.S. PATENT DOCUMENTS

| | | | | |
|---|---|---|---|---|
| 6,404,896 | B1 * | 6/2002 | Yoo et al. | 381/401 |
| 2007/0187172 | A1 * | 8/2007 | Kaneda et al. | 181/181 |
| 2010/0215208 | A1 * | 8/2010 | Sadaie et al. | 381/407 |
| 2011/0051987 | A1 * | 3/2011 | Ueda et al. | 381/412 |
| 2011/0150265 | A1 * | 6/2011 | Pan et al. | 381/400 |

* cited by examiner

*Primary Examiner* — Duc Nguyen
*Assistant Examiner* — Phan Le
(74) *Attorney, Agent, or Firm* — Anova Law Group, PLLC

(57) ABSTRACT

A speaker includes a holder forming a hollow space, a magnetic system received into the hollow space and defining a magnetic gap, an elastic plate assembled with the holder and defining a first surface and a second surface opposite to the first surface, a diaphragm defining a dome part connected with the first surface of the elastic plate and an edge part connected with the second surface of the elastic plate, and at least a coil defining an end suspended in the magnetic gap and an another end connected with the dome part. The edge part defines an arcuate portion depressed toward the magnetic system.

8 Claims, 5 Drawing Sheets

SPEAKER

FIELD OF THE INVENTION

The present disclosure relates to the art of speakers and, particularly to a speaker having a small size.

DESCRIPTION OF RELATED ART

Generally, an electronic device, such as a mobile phone, uses a speaker as a sound generator.

A typically speaker includes a holder having a hollow space, a magnetic system received into the hollow space, a diaphragm attached to the holder and covered on the magnetic system. The diaphragm defines an arcuate portion protrude away from the magnetic system.

In work, the diaphragm can be vibrated approaching and away from the magnetic system. The structure of the speaker should be provided a large vibrating space for the diaphragm to vibrate away from the magnetic system, thereby increasing the height of the speaker.

Therefore, it is desirable to provide a speaker which can overcome the above-mentioned problem.

DETAILED DESCRIPTION

Figure 1:
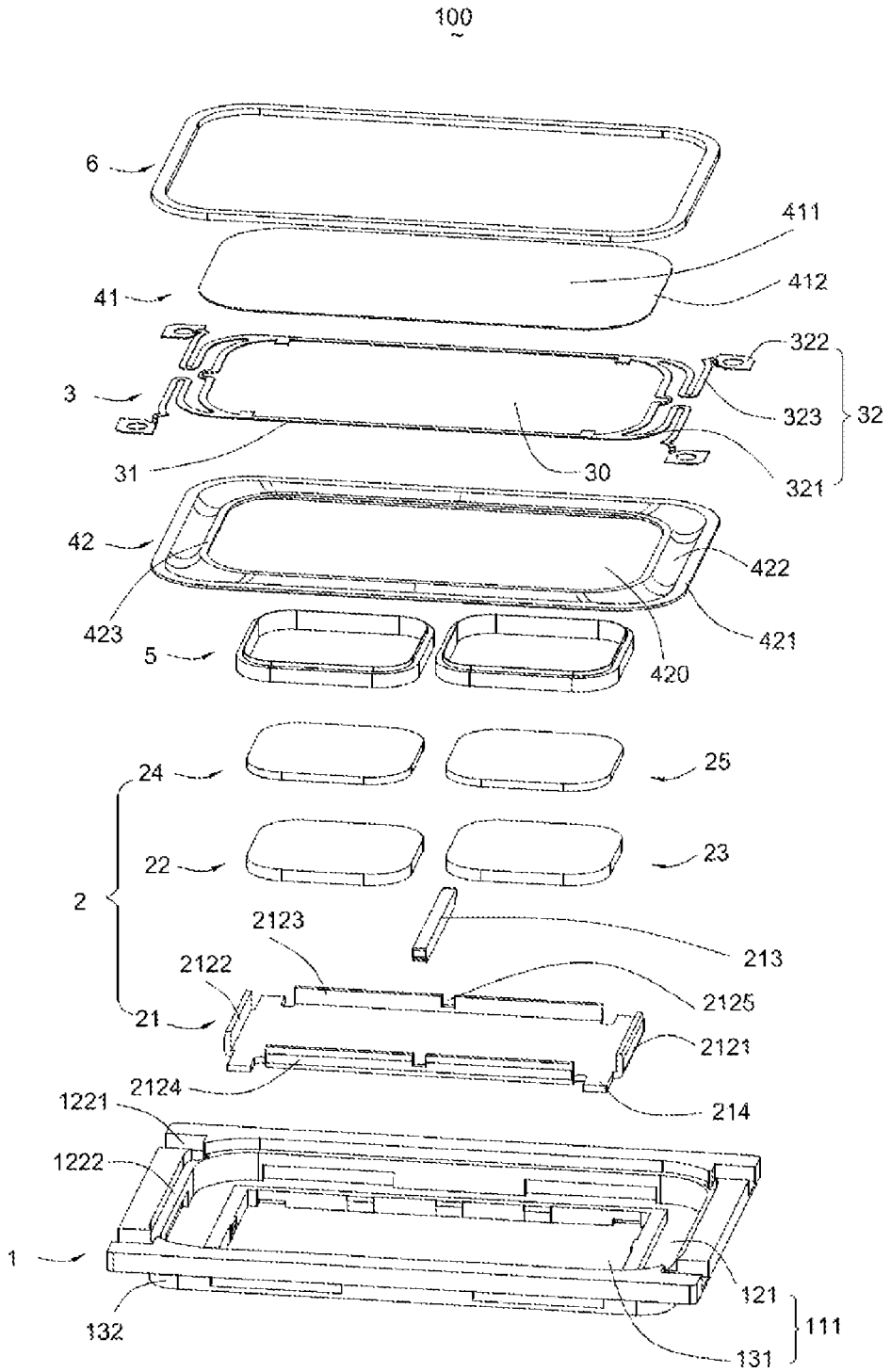
FIG. 1 is an illustrative exploded view of a speaker in accordance with an exemplary embodiment of the present invention.
Figure 2:
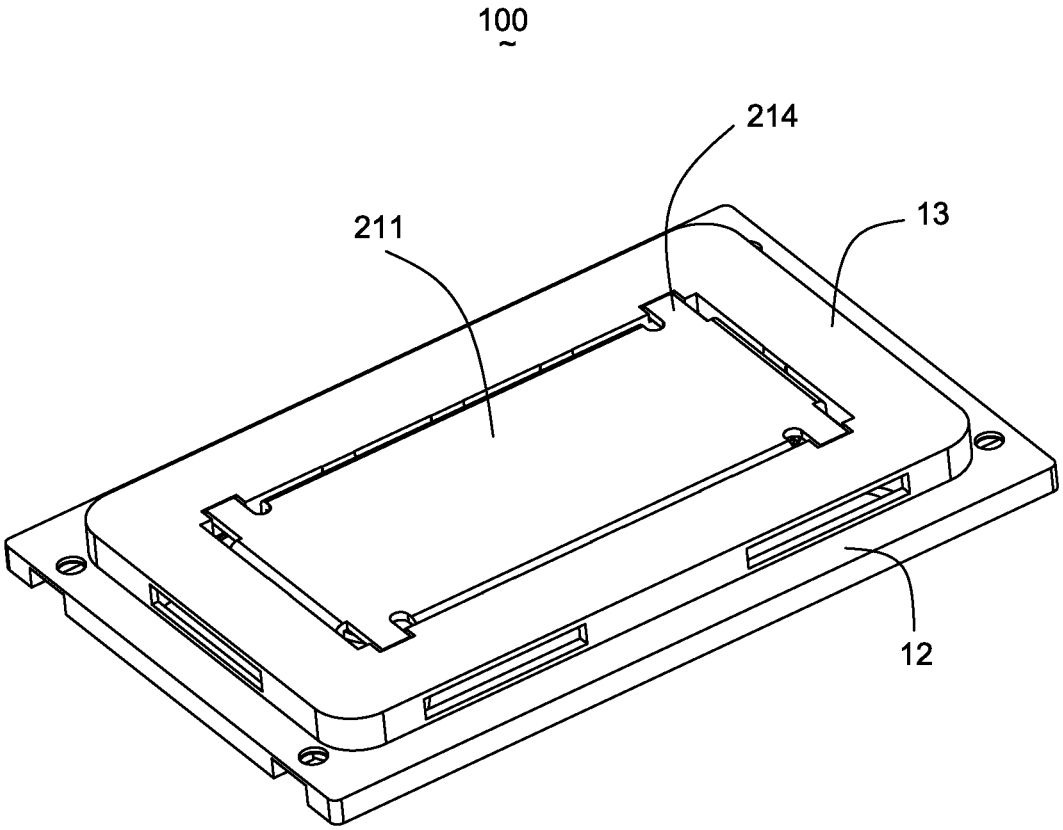
FIG. 2 is an illustrative assembled view of the speaker.
Figure 3:
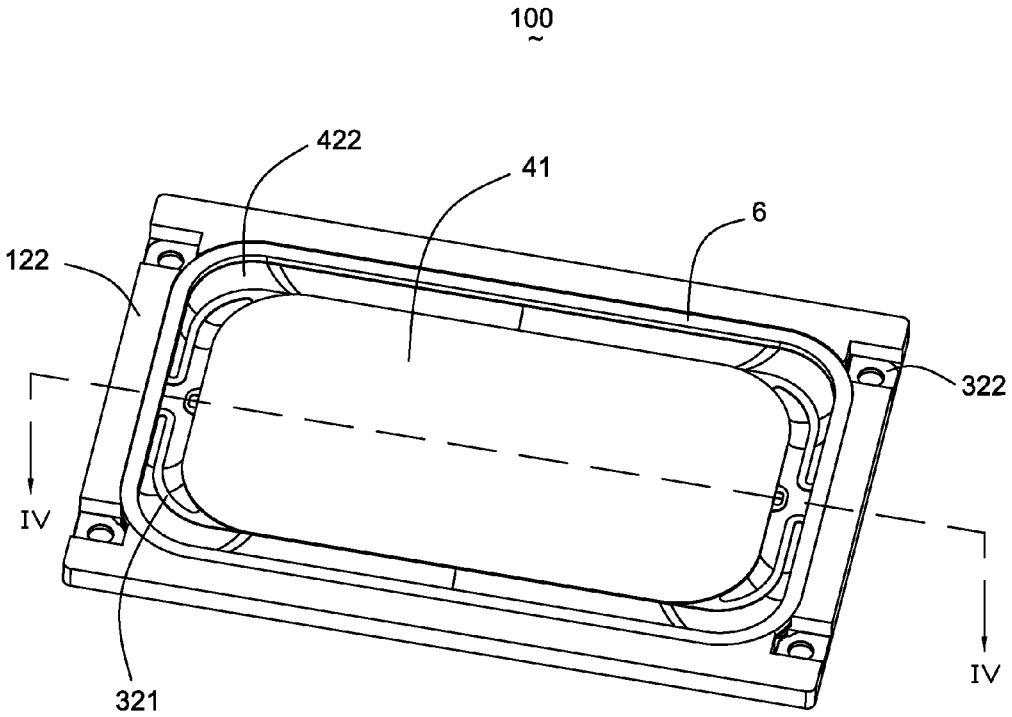
FIG. 3 is similar to FIG. 2, but from another aspect.
Figure 4:
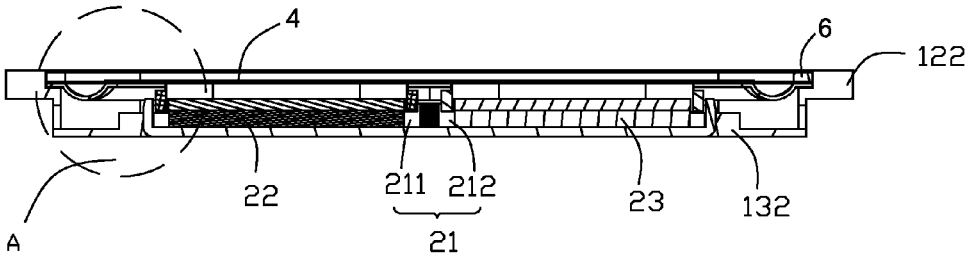
FIG. 4 is a cross-sectional view of the speaker taken along line IV-IV in FIG. 3.
Figure 5:
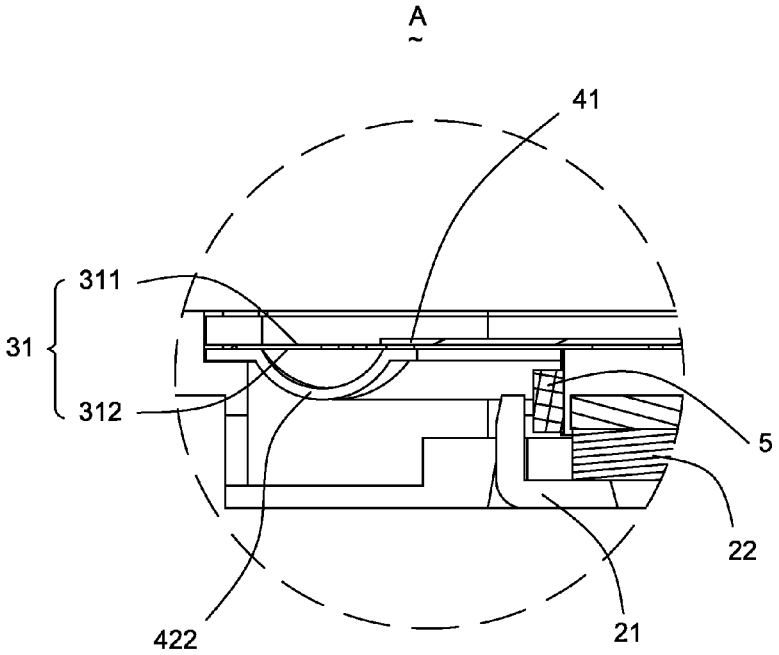
FIG. 5 is an enlarged view of Part A in FIG. 4.
Figure 6:
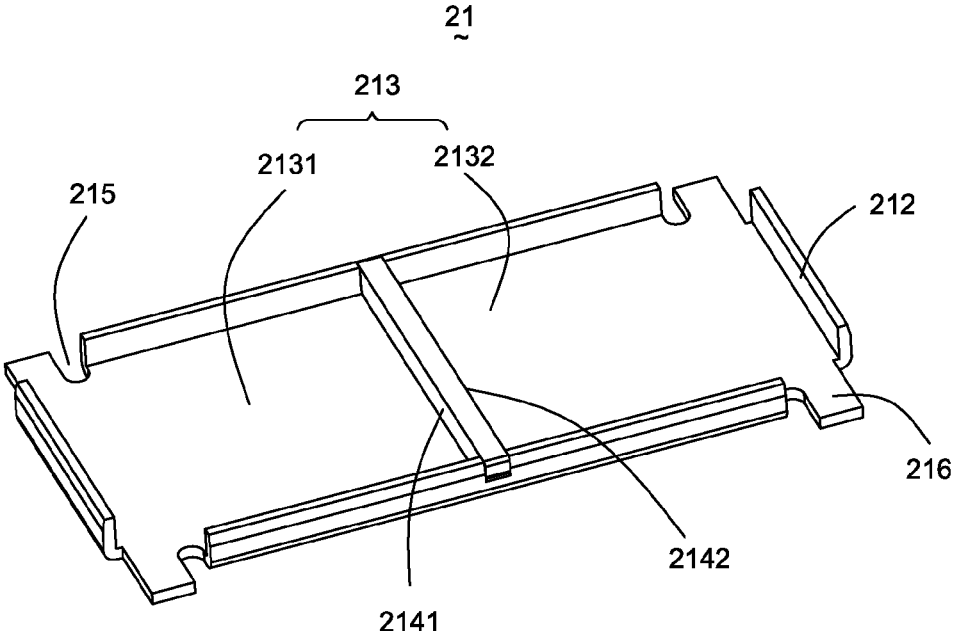
FIG. 6 is an isometric view of a yoke of the speaker.

Referring to FIGS. 1 to 7, a speaker 100, in the exemplary embodiment of the present invention, comprises a holder 1 forming a hollow space 111, a magnetic system 2 received into the hollow space 111 and defining a magnetic gap 21, an elastic plate 3 assembled with the holder 1 and defining a first surface 311 and a second surface 312 opposite to the first surface 311, a diaphragm 4 defining a dome part 41 connected with the first surface 311 of the elastic plate 3 and an edge part 42 connected with the second surface 312 of the elastic plate 3, a fixing cover 6 covered on the diaphragm 4 for fixing the diaphragm 4 on the holder 1 firmly and at least a coil 5 defining an end suspended in the magnetic gap 21 and an another end connected with the dome part 41. The edge part defines an arcuate portion 422 depressed toward the magnetic system 2, The elastic plate 3 comprises a first through hole 30, a fixing portion 31 surrounding the first through hole 30 and a plurality of elastic arms 32 which radiate outwardly from the circumference of two ends of the fixing portion 31. The fixing portion 31 defines a first surface 311 and a second surface 312 opposite to the first surface 311. The elastic arms 32 are provided with a bending portion 321 extending from the edge of the fixing portion 31, a terminal 322 far away from ends of the fixing portion 31, and a serpentine ring 323 smoothly connected with the bending portion 321 and the terminal 322.

The serpentine rings 323 are configured to be parts of a circle, the circle has a same outline as that ends of the fixing portion 31.

Figure 7:
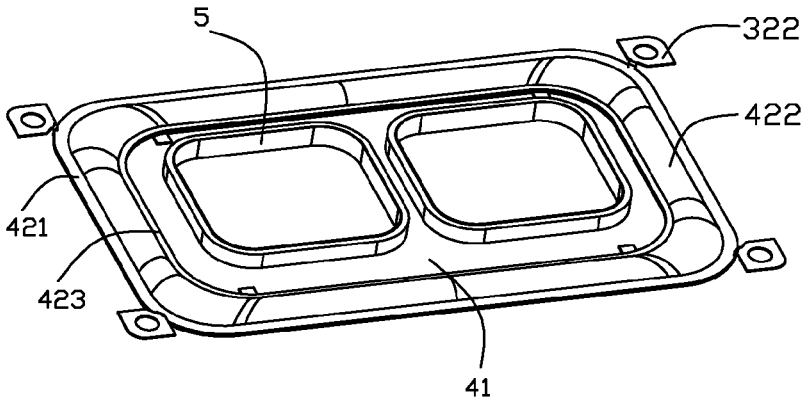
FIG. 7 is an illustrative assembled view of the speaker, a holder and a magnetic system thereof being removed away.

The diaphragm 4 defines a dome part 41 and an edge part 42. The dome part 41 is a planar sheet and defines a center portion 411 and a connecting portion 412 surrounding the center portion 411 for connecting with the first surface 311 of the fixing portion 31. The edge part 42 defines an inner portion 423 connected with the second surface 312 of the fixing portion 31, an outer portion 421 having a diameter that is greater than of the inner portion 423 and mounted onto the holder 1, and an arcuate portion 422 connecting the inner and outer portions 423 and 421 and depressed toward the magnetic system 2. The inner portion 423 of the edge part 42 is closer to the magnetic system 2 than the connecting portion 412 of the dome part 41. Referring to FIGS. 1 and 7, the edge part 42 further comprises a second through hole 420 surrounded by the inner portion 423.

Referring to FIG. 7, the center portion 411 of the dome part 41 is exposed from the inner portion 423 of the edge part. The present invention defines a pair of coils 5. The pair of coils 5 directly connects with the center portion 411 of the dome part 41, respectively, thereby proving a driving force onto the diaphragm 4 rapidly. When assembled, the coils 5 are passed through the first and second through holes 30 and 420 for directly connecting with the center portion 411 of the dome part 41. The fixing portion 31 of the elastic plate 3 is sandwiched between the connecting portion 412 of the dome part 41 and the inner portion 423 of the edge part 42 of the diaphragm 4. Along the vibration direction of the diaphragm 4 approaching the magnetic system 2, the connecting portion 412 of the dome part 41 and the fixing portion 31 of the elastic plate 3 are stacked on the inner portion 423 of the edge part 42 in turn.

The magnetic system 2 defines a yoke 21, a first magnet 22, a second magnet 23, a first pole plate 24 attached onto a top surface of the first magnet 22, and a second pole plate 25 attached onto a top surface of the second magnet 23.

The yoke 21 defines a bottom wall 211, a plurality of sidewalls 212 extending upwardly from the periphery of the bottom wall 211, a receiving chamber 213 surrounded by the bottom wall 211 and the sidewalls 212, a dividing wall 214 connecting with the sidewalls 212 for dividing the receiving chamber 213 into a first chamber 2131 and a second chamber 2132. The bottom wall 211 is approximately rectangular. The sidewalls 212 define a first sidewall 2121, a second sidewall 2122, a third sidewall 2123 and a fourth sidewall 2124. The first and second sidewalls 2121 and 2122 are disposed opposite to each other. Moreover, the third and fourth sidewalls 2123 and 2124 and are disposed opposite to each other. The adjacent sidewalls 212 are unconnected with each other for forming a plurality of corner parts 215. The bottom wall 211 defines a plurality of protrusion parts 216 protruding toward the corner parts 215. The protrusion parts 216 cooperate with the sidewalls 212 for fixing the yoke 21 on the holder 1 firmly. The opposite walls 212 define a pair of receiving grooves 2125 for receiving the two ends of the dividing wall 214 firmly.

The first magnet 22 and pole plate 24 are received into the first chamber 2131. The second magnet 23 and pole plate 25 are received into the second chamber 2132. The dividing wall 214 defines a left side 2141 and a right side 2142 opposite to the left side 2141. The left side 2141 cooperates with the bottom wall 211 and the sidewalls 212 to form a first chamber 2131. The magnetic gap 21 defines a first magnetic gap 211 and a second magnetic gap 212. The outer surface of the first magnet 22 cooperates with the sidewalls 212 and the left side

2141 of the dividing wall 214 for forming a first magnetic gap 211. While, the outer surface of the second magnet 23 cooperates with the sidewalls 212 and the right side 2142 of the dividing wall 214 for forming a second magnetic gap 212. The present invention provides a pair of coil 5 inserted into the first and second magnetic gaps 211 and 212, respectively.

The holder 1 defines a base portion 12 and a body portion 13 connected with the base portion 12. The hollow space 111 defines a first hollow space 121 formed on the base portion 12 for receiving the elastic plate 3, the diaphragm 4 and a part of the coil 5 and a second hollow space 131 formed on the body portion 13 for receiving the magnetic system 2 and another part of the coil 5. The base portion 12 further defines a mounted portion 122 surrounded the first hollow space 121. The body portion 13 further defines a holding portion 132 surround the second hollow space 131. The first hollow space 121 is communicated with the second hollow space 131. A diameter of the first hollow space 121 is greater than that of the second hollow space 131. The mounted portion 122 defines a plurality of receiving concave 1221 extending from an inner surface thereof toward an outer surface thereof for receiving the terminals 322 of the elastic plate 3 and a step portion 1222 extending from an upper surface of the mounted portion 122 towards the body portion 13 for fixing the serpentine ring 323 of the elastic plate 3.

The present invention of the speaker defines an edge part having an arcuate portion depressed toward the magnetic system, thereby reducing the vibrating space provided for the diaphragm to vibrate away from the magnetic system.

It will be understood that the above particular embodiment is shown and described by way of illustration only. The principles and the features of the present disclosure may be employed in various and numerous embodiments thereof without departing from the scope of the disclosure as claimed. The above-described embodiment illustrates the scope of the disclosure but do not restrict the scope of the disclosure.

What is claimed is:

1. A speaker comprising:

a holder forming a hollow space;

a magnetic system received into the hollow space and defining a magnetic gap;

an elastic plate assembled with the holder and defining an fixing portion forming a first through hole, the fixing portion defining a first surface and a second surface opposite to the first surface;

a diaphragm having a dome part defining a center portion and a connecting portion surrounding the center portion connected with the first surface of the elastic plate, and an edge part separated from the dome part and defining a second through hole, an inner portion surrounding the second through hole and connected with the second surface of the elastic plate, an outer portion having a diameter that is larger than that of the inner portion, and an arcuate portion connecting the inner and outer portions and depressed toward the magnetic system; and a coil defining an end suspended in the magnetic gap and an another end directly connected with the center portion of the dome part through the first and second through holes for providing a driving force onto the diaphragm rapidly.

2. The speaker as claimed in claim 1, wherein the magnetic system defines a yoke having a bottom wall, a plurality of sidewalls extending upwardly from the periphery of the bottom wall, a receiving chamber surrounded by the bottom wall and the sidewalls, and a dividing wall connected with a pair of sidewalls for dividing the receiving chamber into a first chamber and a second chamber.

3. The speaker as claimed in claim 1, wherein the elastic plate further defines a plurality of elastic arms which radiate outwardly from the circumference of two ends of the fixing portion.

4. The speaker as claimed in claim 3, wherein each elastic arm defines a bending portion extending from the edge of the fixing portion, a terminal far away from ends of the fixing portion, and a serpentine ring smoothly connected with the bending portion and the terminal.

5. The speaker as claimed in claim 4, wherein each serpentine ring are configured to be parts of a circle, the circle has a same outline as that ends of the fixing portion.

6. The speaker as claimed in claim 2, wherein the adjacent sidewalls of the yoke are unconnected with each other for forming a plurality of corner parts and the bottom wall of the yoke defines a plurality of protrusion parts protruding toward the corner parts.

7. The speaker as claimed in claim 6, wherein the opposite walls define a pair of receiving grooves for receiving the two ends of the dividing wall firmly.

8. The speaker as claimed in claim 1, wherein along the vibration direction of the diaphragm approaching the magnetic system, the connecting portion of the dome part and the fixing portion of the elastic plate are stacked on the inner portion of the edge part in turn.

* * * * *